US010210987B2

(12) United States Patent
Kotani et al.

(10) Patent No.: US 10,210,987 B2
(45) Date of Patent: Feb. 19, 2019

(54) COMPOSITE MAGNETIC MATERIAL, COIL COMPONENT USING SAME, AND COMPOSITE MAGNETIC MATERIAL MANUFACTURING METHOD

(71) Applicant: Panasonic Intellectual Property Management Co., Ltd., Osaka (JP)

(72) Inventors: Junichi Kotani, Hyogo (JP); Nobuya Matsutani, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 38 days.

(21) Appl. No.: 15/305,941

(22) PCT Filed: Jul. 16, 2015

(86) PCT No.: PCT/JP2015/003593

§ 371 (c)(1),
(2) Date: Oct. 21, 2016

(87) PCT Pub. No.: WO2016/013183

PCT Pub. Date: Jan. 28, 2016

(65) Prior Publication Data

US 2017/0053729 A1 Feb. 23, 2017

(30) Foreign Application Priority Data

Jul. 22, 2014 (JP) ..... 2014-148437

(51) Int. Cl.
*H01F 27/25* (2006.01)
*H01F 1/33* (2006.01)
(Continued)

(52) U.S. Cl.
CPC ..... *H01F 27/255* (2013.01); *H01F 1/14733* (2013.01); *H01F 1/14791* (2013.01);
(Continued)

(58) Field of Classification Search
None
See application file for complete search history.

(56) References Cited

U.S. PATENT DOCUMENTS 5,120,366 A * 6/1992 Harada ..... H01F 1/37 106/456
8,366,837 B2 * 2/2013 Wakabayashi ..... B22F 1/0062 148/104
(Continued)

FOREIGN PATENT DOCUMENTS

CN 102067251 A 5/2011
CN 102969109 A 3/2013
(Continued)

OTHER PUBLICATIONS

Derwent Abstract Translation of JP 2004-253787 A. (Year: 2004).*
(Continued)

*Primary Examiner* — Kevin M Bernatz
(74) *Attorney, Agent, or Firm* — McDermott Will & Emery LLP

(57) ABSTRACT

A composite magnetic material includes first particles made of soft magnetic metal and second particles provided between first particles. Each of the second particles includes a first solid phase and a second solid phase. The composite magnetic material exhibits high magnetic characteristics.

14 Claims, 4 Drawing Sheets

(51) Int. Cl.

| | |
|---|---|
| ***H01F 27/255*** | (2006.01) |
| ***H01F 1/147*** | (2006.01) |
| ***H01F 1/36*** | (2006.01) |
| ***H01F 41/02*** | (2006.01) |
| ***H01F 1/24*** | (2006.01) |
| *H01F 1/26* | (2006.01) |

(52) U.S. Cl.
CPC ..... *H01F 1/24* (2013.01); *H01F 1/33* (2013.01); *H01F 1/36* (2013.01); *H01F 41/0246* (2013.01); *H01F 1/26* (2013.01)

(56) References Cited

U.S. PATENT DOCUMENTS 8,377,576 B2 * 2/2013 Xiao ..... B82Y 25/00 428/692.1
2003/0127157 A1 * 7/2003 Iyoda ..... B22F 1/0096 148/104
2004/0020569 A1 * 2/2004 Kanekiyo ..... B82Y 25/00 148/302
2005/0074600 A1 * 4/2005 Ma ..... B82Y 25/00 428/328
2010/0060539 A1 * 3/2010 Suetsuna ..... H01F 1/33 343/787
2010/0289609 A1 11/2010 Liao et al.
2010/0323206 A1 12/2010 Soma et al.
2011/0240909 A1 * 10/2011 Kanda ..... H01F 1/0555 252/62.55
2013/0228716 A1 * 9/2013 Suetsuna ..... B22F 1/02 252/62.55
2013/0228717 A1 * 9/2013 Harada ..... H01F 1/26 252/62.55
2013/0298730 A1 * 11/2013 Ikeda ..... B22F 1/02 75/230
2014/0002221 A1 * 1/2014 Shin ..... H01F 17/04 336/83
2014/0132376 A1 * 5/2014 Jin ..... H01F 1/0552 335/302
2014/0132383 A1 * 5/2014 Matsuura ..... B22F 1/02 336/83
2014/0139311 A1 * 5/2014 Matsuura ..... H01F 1/14783 336/221
2014/0265716 A1 * 9/2014 Kim ..... H01F 3/08 310/216.067
2014/0271323 A1 * 9/2014 Wang ..... H01F 41/0266 419/25
2014/0319406 A1 10/2014 Suetsuna et al.

FOREIGN PATENT DOCUMENTS

JP 2004253787 A * 9/2004
JP 2010238930 A * 10/2010
JP 2013-051329 3/2013
JP 2013-065844 4/2013
JP 2014216495 A * 11/2014

OTHER PUBLICATIONS

English Translation of Chinese Search Report dated Feb. 24, 2018 for the related Chinese Patent Application No. 201580029972.6.
International Search Report of PCT application No. PCT/JP2015/003593 dated Oct. 6, 2015.

* cited by examiner

COMPOSITE MAGNETIC MATERIAL, COIL COMPONENT USING SAME, AND COMPOSITE MAGNETIC MATERIAL MANUFACTURING METHOD

This application is a U.S. national stage application of the PCT international application No.PCT/JP2015/003593 filed on Jul. 16, 2015, which claims the benefit of foreign priority of Japanese patent application No. 2014-148437 filed on Jul. 22, 2014, the contents all of which are incorporated herein by reference.

TECHNICAL FIELD

The present invention relates to composite magnetic material with excellent magnetic characteristics, a coil component using the composite magnetic material, and a method for manufacturing the composite magnetic material.

BACKGROUND ART

PTL1 discloses a conventional composite magnetic material formed by mixing first particles, second particles, and insulating particles.

The composite magnetic material disclosed in PTL 1 does not exhibit sufficiently high magnetic characteristics.

CITATION LIST

Patent Literature

PTL 1: U.S. Patent Application Publication No. 2010/0289609

SUMMARY

A composite magnetic material includes first particles made of soft magnetic metal and second particles provided between first particles. Each of the second particles includes a first solid phase and a second solid phase.

The composite magnetic material exhibits high magnetic characteristics.

DETAIL DESCRIPTION OF PREFERRED EMBODIMENT

Figure 1:
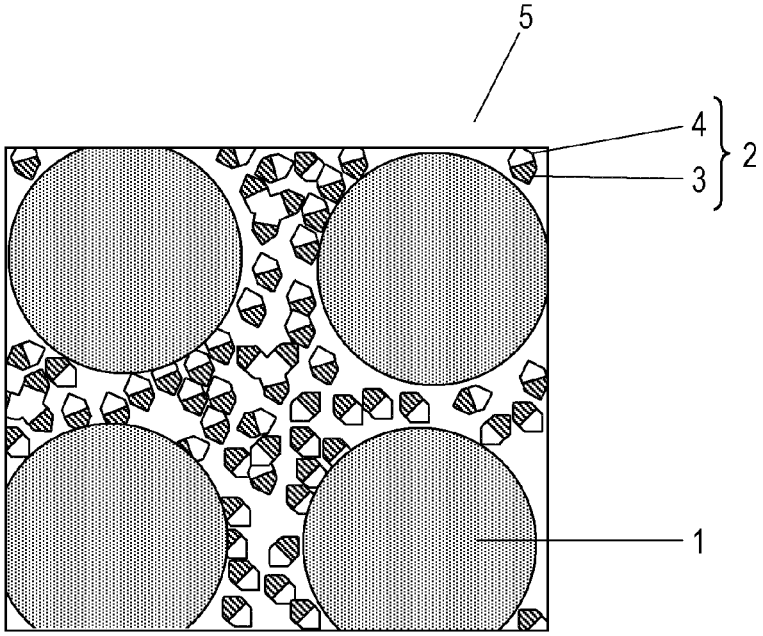
FIG. 1 is a cross-sectional view of a composite magnetic material in accordance with the exemplary embodiment of the present invention.

FIG. 1 is a cross-sectional view of composite magnetic material 5 according to an exemplary embodiment. Composite magnetic material 5 includes first particles 1 made of soft magnetic metal and second particles 2 provided between first particles 1. Each of second particles 2 includes first solid phase 3 and second solid phase 4.

Composite magnetic material 5 has a smaller number of voids formed between the particles than a composite magnetic material formed by simply mixing different two particles: first solid phase 3; and second solid phase 4. This allows first particles made of the soft magnetic metal to fill at a high filling rate.

Second particles 2 will be detailed below. In each of second particles 2, first solid phase 3 is made of insulator while second solid phase 4 is made of magnetic material. This configuration allows second solid phase 4 made of the magnetic material to fills at a high filling rate, not only first particles 1 made of the soft magnetic metal.

Further, first solid phase 3 made of the insulator prevents a contact between first particles 1 made of the soft magnetic metal, a contact between second solid phases 4 made of the magnetic material, and a contact between first particles 1 made of the soft magnetic metal and second solid phases 4 made of the magnetic material, hence suppressing an eddy current generated thereon.

Second solid phase 4 of the magnetic material may be metal, specifically, a simple substance of one metal selected from Fe, Co, and Ni. Fe, Co, and Ni have magnetic property, hence allowing composite magnetic material 5 to have high magnetic characteristics.

The metal may be Fe—Si based alloy, Fe—Si—Al based alloy, Fe—Si—Cr based alloy, or Fe—Ni based alloy. These alloys also have magnetic characteristics, hence allowing composite magnetic material 5 to have high magnetic characteristics.

Second particles 2, as shown in FIG. 1, may be physically bonded partly with each other. In this case, first solid phases 3 second particles 2 are bonded with each other, or second solid phases 4 of second particles 2 are bonded with each other. This physical bonding of second particles 2 enhances mechanical strength of composite magnetic material 5. First solid phases 3 may be bonded with second solid phases 4, thereby enhancing the mechanical strength of composite magnetic material 5.

Figure 2A:
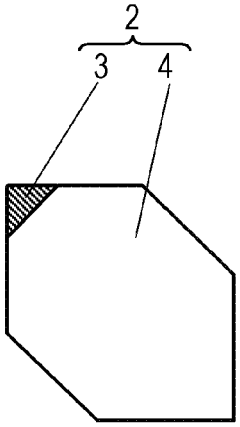
FIG. 2A is a cross-sectional view of a second particle of the composite magnetic material in accordance with the embodiment.
Figure 2B:
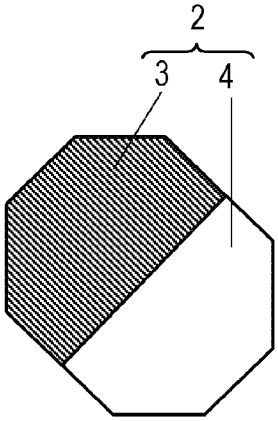
FIG. 2B is a cross-sectional view of another second particle of the composite magnetic material in accordance with the embodiment.
Figure 2C:
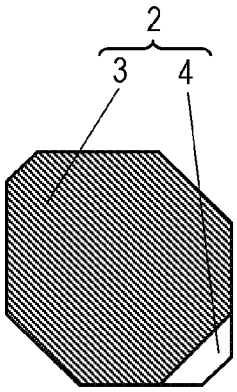
FIG. 2C is a cross-sectional view of still another second particle of the composite magnetic material in accordance with the embodiment.

Second particles 2 according to the embodiment does not have a two-layer structure in which one solid phase is disposed over the surface of the other solid phase, but has a structure in which the solid phases is formed to inside the structure in cross sections of the particles. FIG. 2A is a cross-sectional view of the second particle of composite magnetic material 5 in accordance with the embodiment. FIG. 2B is a cross-sectional view of another second particle of composite magnetic material 5 in accordance with the embodiment. FIG. 2C is a cross-sectional view of still another second particle of composite magnetic material 5 in accordance with the embodiment. The cross sections of second particle 2 shown in FIG. 2A to FIG. 2C shows that first solid phase 3 and second solid phase 4 are formed not only on the surface of second particle 2 but also to the inside of the particle.

First solid phase 3 made of insulator is made of oxide. The oxide may contain at least one of Al, Cr, Ti, Mg, Si, and Ca, more in detail, $Al_2O_3$, $Cr_2O_3$, TiO, MgO, $SiO_2$, or composite oxide containing plural kinds of the above elements.

Composite magnetic material 5 according to the embodiment is formed by a thermal process in an inert atmosphere. This process will be described later.

Figure 3:
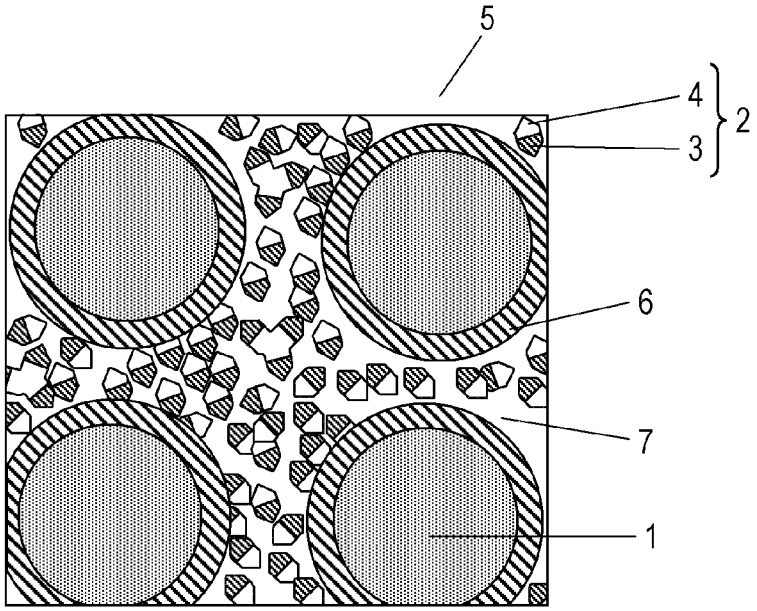
FIG. 3 is a cross-sectional view of a composite magnetic material in accordance with the exemplary embodiment.

First particles 1 will be detailed below. FIG. 3 is a cross-sectional view of composite magnetic material 5 for particularly showing first particles 1. Oxidized film 6 containing Al, Cr, Ti, Mg, Si, or Ca may be formed on the surface of first particle 1 made of soft magnetic metal. Oxidized film 6 may be made of $Al_2O_3$, $Cr_2O_3$, $TiO_2$, MgO, $SiO_2$, or composite oxide containing the above elements. Oxidized film 6 over the surface of each of first particles 1 prevents first particles 1 made of the soft magnetic metal from contacting each other, or prevents first particles 1 made of the soft magnetic metal from contacting second solid phases 4 made of magnetic material, hence suppressing eddy currents generated thereon. The thickness of oxidized film 6 may preferably be equal to or larger than 10 nm and equal to or smaller than 500 nm.

Oxidized films 6 according to the embodiment are formed over the surfaces of first particles 1 such that a part of a metal contained in each of first particles 1 made of the soft magnetic metal is thermally processed to be oxidized, but it is not limited to; oxidized film 6 may be made of an oxide of a metal that is not contained in first particles 1 made of the soft magnetic metal.

Figure 4:
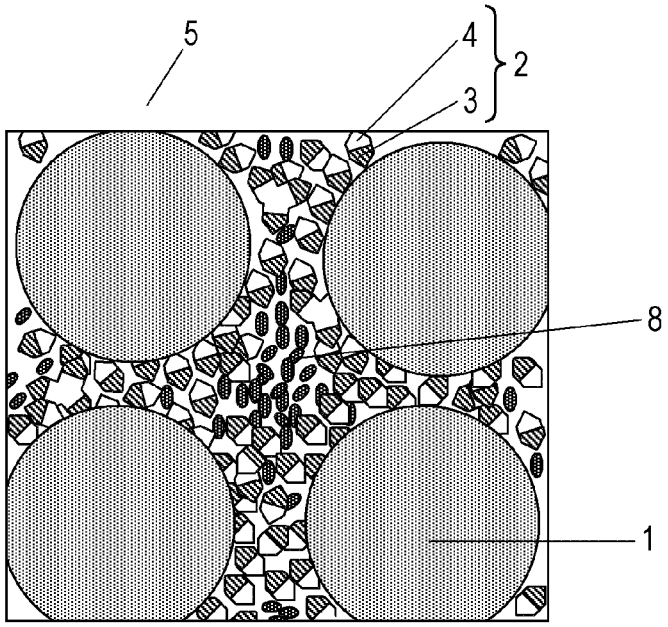
FIG. 4 is a cross-sectional view of a further composite magnetic material in accordance with the embodiment.

FIG. 4 is a cross-sectional view of another composite magnetic material 5 in accordance with the embodiment. Composite magnetic material 5, as shown in FIG. 4, may further contain third particles 8 made of insulator between second particles 2.

Third particle 8 has a crystal structure different from that of first solid phase 3 and the second solid phase 4 of second particle 2. Third particle 8 may be made of various kinds of ferrite material; more in detail, Mn—Zn based ferrite, Ni—Zn based ferrite, Mg—Zn based ferrite, or spinel-type ferrite, such as hercynite. Spinel-type ferrite may be formed by adding some elements to hercynite as to have magnetic characteristics.

Besides, third particles 8 may be surrounded by second particles 2.

For example, in the case that $FeAl_2O_4$ is employed for a starting material in the process of forming second particles 2, first solid phase 3 made of oxide containing Al and second solid phase 4 made of Fe are formed by the thermal process, which will be described later.

To be specific, when $FeAl_2O_4$ is processed in an inert atmosphere at a temperature of 1000° C., the material of $FeAl_2O_4$ is partly reduced, so that first solid phase 3 made of oxide containing Al and second solid phase 4 made of Fe are formed. At this moment, not all the amount of $FeAl_2O_4$ is reacted, i.e., a part of $FeAl_2O_4$ is remained as it is, thereby providing third particles 8 made of insulating material. Third particles 8 made of insulating material remaining in the structure increases an insulating component for insulating between first particles 1 made of soft magnetic metal, accordingly suppressing an eddy current. The number per unit volume of third particles 8 may increase as the distance from first particles 1 made of soft magnetic metal increases.

Composite magnetic material 5, as shown in FIG. 3, may contain voids 7 between first particles 1 and second particles 2. Voids 7 may communicate with each other.

Figure 5:
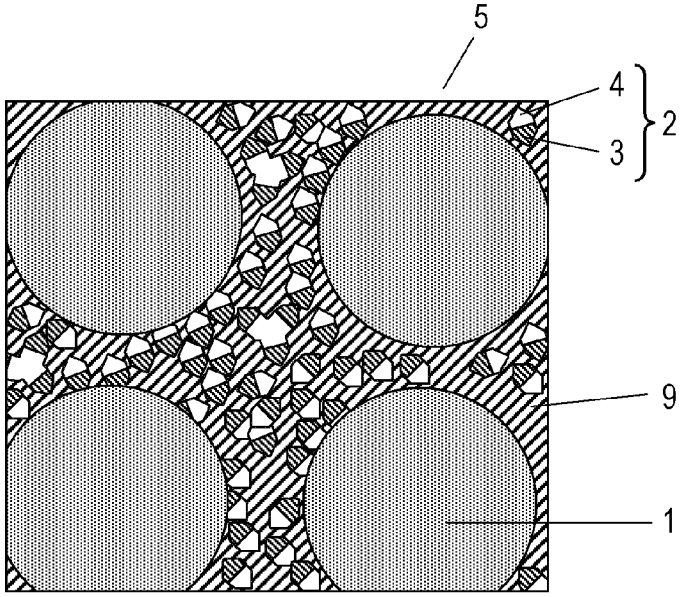
FIG. 5 is a cross-sectional view of a further composite magnetic material in accordance with the embodiment.

FIG. 5 is a cross-sectional view of still another composite magnetic material 5 according to the embodiment. In composite magnetic material 5 shown in FIG. 5, organic resin 9 fills voids 7. Organic resin 9 is impregnated into voids 7 and hardened to increase the bonding strength between first particles 1 made of soft magnetic metal and second particles 2, thereby increasing the mechanical strength of composite magnetic material 5. Besides, voids 7 communicated with each other allows organic resin 9 to easily impregnate into composite magnetic material 5, contributing to shortened lead time in the manufacturing process.

First particles 1 made of soft magnetic metal according to the embodiment will be described below.

A single substance of metal, at least one of Fe, Co, and Ni as magnetic material, is a specific example of the soft magnetic metal. The soft magnetic metal may be Fe—Si based alloy, Fe—Si—Al based alloy, Fe—Si—Cr based alloy, or Fe—Ni based alloy. The average particle diameter of first particles 1 made of soft magnetic metal may preferably be equal to or larger than 1 μm and equal to or smaller than 100 μm. The average particle diameter of first particles 1 of soft magnetic metal equal to or larger than 1 μm provides effects that, in manufacturing processes, first particles 1 is mixed without having aggregation with other materials. In dispersing, first particles 1 move apart from each other and form independent particles. Eddy-current loss in composite magnetic material 5 increases in proportion to the square of the size of a portion in which an eddy current flows. In order to reduce an effect of eddy currents, the average particle diameter of first particles 1 may preferably be equal to or smaller than about 100 μm. More preferably, the average particle diameter of first particles 1 may be equal to or larger than 3 μm and equal to or smaller than 50 μm. This range of the average particle diameter suppresses aggregation of first particles 1, suppressing generation of eddy currents.

As for the values of the average particle diameter, some errors may be observed between measurement methods; accordingly, the aforementioned preferable range of the average particle diameter can change in an error margin.

The average particle diameter of second particles 2 is not limited to a specific value, but may preferably be smaller than that of first particles 1. This configuration allows first solid phase 3 of oxide to exhibit high insulation effect between first particles 1 of soft magnetic metal, suppressing generation of eddy currents.

According to the embodiment, values of respective average particle diameters of first particles 1 and second particles 2 are measured at a cross section of composite magnetic material 5. The average particle diameter is calculated by obtaining diameters of 200 or more first particles 1 or second particles 2 at a cross section with an image analyzing device as equivalent circle diameters, and accumulating the diameters. The particle diameter at which the cumulative value corresponds to 50% of the total number of the particles is determined as the average particle diameter.

The material compositions of first solid phases 3, second solid phase 4, and oxidized film 6 of second particles 2 is observed by element assay of the cross section of composite magnetic material 5 with an X-ray micro analyzer (XMA).

Figure 6:
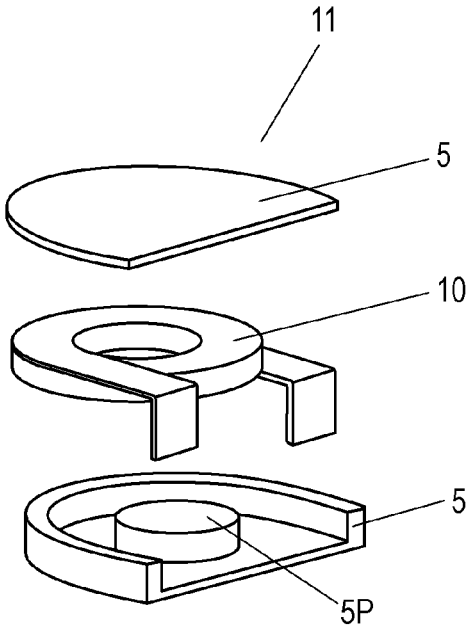
FIG. 6 is an exploded perspective view of a coil component in accordance with the embodiment.

FIG. 6 is a perspective view of coil component 11 including composite magnetic material 5. Coil component 11 includes coil 10 wound around at least a part of composite magnetic material 5. Coil 10 of the embodiment is wound around part 5P of composite magnetic material 5. Composite magnetic material 5 according to the embodiment contains magnetic material at a high filling rate and suppresses generation of eddy current, which provides coil component 11 with a small size and a low-profile structure.

A method for manufacturing composite magnetic material 5 according to the embodiment will be described below.

First, as first particles 1 made of soft magnetic metal, Fe—Si—Al alloy powder having an average particle diameter of 30 μm and composed of 10.0 weight % of Si, 5.0 weight % of Al, and the balance of Fe. The Fe—Si—Al alloy powder is prepared by gas atomization. Second particles 2 are made of $FeAl_2O_4$ powder and have an average particle diameter of 0.2 μm. A first additive amount, the amount of $FeAl_2O_4$ powder (second particles 2) to be added into 100 parts by weight of Fe—Si—Al alloy powder (first particles 1) is 15 parts by weight. The Fe—Si—Al alloy powder and the $FeAl_2O_4$ powder are mixed together and dispersed. Acrylic resin and organic solvent are mixed to the powders to form mixture, and then, the mixture is dispersed with a rotary ball mill, thereby providing the mixture material.

In the mixing and dispersing process of the Fe—Si—Al alloy powder (first particles 1), the $FeAl_2O_4$ powder (second particles 2), the acrylic resin, and the organic solvent, there is no particular order in mixing and dispersing.

As described above, the average particle diameter of composite magnetic material 5 is obtained by measurement on a cross section of composite magnetic material 5. However, the average particle diameter of the starting material of the Fe—Si—Al alloy powder and the $FeAl_2O_4$ powder is D50 values measured by laser diffraction scattering method.

Next, the mixture material is pressure-molded at pressure of 8 ton/cm$^2$, thereby providing a molded body having a predetermined shape.

Next, a thermal process is performed to the molded body in an inert atmosphere, that is, is heated for five hours at a temperature of 1200° C. in a nitrogen atmosphere as to release a distortion generated in the Fe—Si—Al alloy powder in the pressure molding. Further, the thermal process removes oxygen from the $FeAl_2O_4$ powder, thereby forming second particles 2 having two solid phases: first solid phase 3 of Fe and second solid phase 4 of oxide containing Al.

The temperature in the thermal process may preferably be equal to or higher than 1000° C. and equal to or lower than 1300° C., and the heating time may preferably be equal to or higher less than 0.5 hours and equal to or shorter than 6 hours.

When the thermal process is performed at temperatures lower than the above range (for example, at about 1000° C.), not the entire $FeAl_2O_4$ powder reacts and allows a part of the $FeAl_2O_4$ powder remain as third particles 8. Third particles 8 function as insulator that prevents the contact between first particles 1. In order to remain a part of the $FeAl_2O_4$ powder as third particles 8, the temperature at the thermal process may preferably be equal to or higher than 600° C. and equal to or lower than 1200° C., and the heating time may preferably be equal to or longer than 0.5 hours and equal to or shorter than 6 hours.

When a high-temperature thermal process in an oxygen atmosphere is previously performed to the Fe—Si—Al alloy powder before being mixed with other materials, oxidized film 6, is formed on the surfaces of first particles 1, as shown in FIG. 3. In order to form oxidized film 6 on the surfaces of first particles 1, the temperature at the thermal process may preferably be equal to or higher than 500° C. and equal to or lower than 1200° C., and the heating time may preferably be equal to or longer than 0.5 hours and equal to or shorter than 6 hours.

In composite magnetic material 5 according to the embodiment, as described above, each of second particles 2 includes first solid phase 3 made of insulator and second solid phase 4 made of magnetic material. This configuration decreases voids 7 formed between the particles, and allows composite magnetic material 5 to contain a lot of the first particles and a lot of second solid phase 4 as magnetic material.

Further, first solid phase 3 made of insulator prevents the contact between first particles 1 made of soft magnetic metal, the contact between second solid phases 4, and the contact between of first particles 1 and second solid phases 4, accordingly suppressing generation eddy currents.

INDUSTRIAL APPLICABILITY

A composite magnetic material according to the embodiment has high magnetic characteristics and is useful for coil components having various types of magnetic material.

REFERENCE MARKS IN THE DRAWINGS

1 first particle
2 second particle
3 first solid phase
4 second solid phase
5 composite magnetic material
6 oxidized film
7 voids
8 third particle
9 organic resin
10 coil
11 coil component

The invention claimed is:

1. A composite magnetic material comprising:
a plurality of first particles made of soft magnetic metal;
a plurality of second particles provided between the plurality of first particles; and
a plurality of third particles made of insulating material disposed between the plurality of second particles,
wherein, each of the plurality of second particles includes a first solid phase and a second solid phase.

2. The composite magnetic material of claim 1, wherein the first solid phase is made of oxide.

3. The composite magnetic material of claim 2, wherein the oxide contains at least one of Al, Cr, Ti, Mg, Si, and Ca.

4. The composite magnetic material of claim 1, wherein the second solid phase is made of metal.

5. The composite magnetic material of claim 4, wherein the metal is one selected from the group consisting of Fe, Co, Ni, Fe—Si based alloy, Fe—Si—Al based alloy, Fe—Si—Cr based alloy, and Fe—Ni based alloy.

6. The composite magnetic material of claim 1, wherein the insulating material is spinel-type ferrite.

7. The composite magnetic material of claim 1, wherein a number of the plurality of third particles per unit volume of the composite magnetic material increases as being distanced away from the plurality of first particles.

8. The composite magnetic material of claim 1, wherein a plurality of voids is provided between the plurality of first particles and the plurality of second particles.

9. The composite magnetic material of claim 8, wherein the plurality of voids communicates with each other.

10. The composite magnetic material of claim 1, further comprising an organic resin disposed between the plurality of first particles and the plurality of second particles.

11. The composite magnetic material of claim 1, wherein an average diameter of the plurality of first particles is larger than an average diameter of the plurality of second particles.

12. The composite magnetic material of claim 1, wherein an average particle diameter of the plurality of first particles is equal to or larger than 1 μm and is equal to or smaller than 100 μm.

13. The composite magnetic material of claim 1, further comprising an oxidized film disposed on each of surfaces of the plurality of first particles.

14. A coil component comprising:

the composite magnetic material of claim 1; and a coil wound around at least a part of the composite magnetic material.

* * * * *